US005177715A

United States Patent [19]

Bonvin

[11] Patent Number: 5,177,715

[45] Date of Patent: Jan. 5, 1993

[54] TIMEPIECE CAPABLE OF BEING WORN IN VARIOUS WAYS

[75] Inventor: Joël Bonvin, Crans sur Sierre, Switzerland

[73] Assignee: ETA SA Fabriques d'Ebauches, Granges, Switzerland

[21] Appl. No.: 761,232

[22] Filed: Sep. 17, 1991

[30] Foreign Application Priority Data

Sep. 19, 1990 [CH] Switzerland ..... 03031/90

[51] Int. Cl.[5] ..... G04B 19/04; G04B 37/00

[52] U.S. Cl. ..... 368/80; 368/223; 368/281

[58] Field of Search ..... 368/76, 80, 223-232, 368/281-282

[56] References Cited

U.S. PATENT DOCUMENTS 4,236,239 11/1980 Imgruth et al. ..... 368/72
4,493,561 1/1985 Bouchet ..... 368/281

FOREIGN PATENT DOCUMENTS 2111657 9/1972 Fed. Rep. of Germany .
8515600 8/1985 Fed. Rep. of Germany .
1758568 6/1970 Switzerland .

*Primary Examiner*—Vit W. Miska
*Attorney, Agent, or Firm*—Weil, Gotshal & Manges

[57] ABSTRACT

An analog timepiece in which the hands are in a given set position, for example superimposed at 12 hrs, to indicate a time reference, for example noon. This timepiece has adjustment means to change the said time reference in relation to the dial. Thus, for example, reorientating the said time reference through 180° to 6.00 hrs, a wristwatch designed to be worn on the left wrist can be converted into a wristwatch designed to be worn on the right wrist.

10 Claims, 3 Drawing Sheets

TIMEPIECE CAPABLE OF BEING WORN IN VARIOUS WAYS

FIELD OF THE INVENTION

The present invention relates to a timepiece that can be worn in various ways, notably as a wristwatch for the left- or right-handed, or as a pocket watch.

DESCRIPTION OF THE PRIOR ART

Swiss Patent No. 56,635 describes a pocket watch, the control shaft of which, provided with a loop, is at 12 hrs and which has at 6 hrs a sliding ring making it possible to mount this watch on a wristlet passing through this loop and this sliding ring. A similar design, with the control shaft at 6 hrs, is described in Swiss Patent No. 220,795.

It is cumbersome to use these two designs in the form of a wristwatch since the control shaft, which is at 6 hrs or 12 hrs, is difficult to reach whereas, in a normal wristwatch, i.e. one worn on the left wrist, the control shaft is at 3 hrs.

A wristwatch that can be worn either on the left wrist or the right wrist is also known, in particular from Swiss Patent No. 548,633. According to this document, the watch case is mounted on a false base to which the wristlet is fitted, and this case is rotatably orientatable in relation to the false base. This makes it possible to transform a watch normally worn on the left wrist (control shaft at 3 hrs) into a watch that can be worn on the right wrist (control shaft at 9 hrs) by turning the case by 180° in relation to the false base.

DE-2,111,657 discloses a wristwatch, the dial of which can be turned by 180°, which also makes it possible to use this wristwatch on the left wrist or the right wrist and always have the control shaft at the correct place, i.e. at 3 hrs and 9 hrs respectively.

However, these designs are not entirely satisfactory for the wearer since the time is not accurately displayed. When the watch is worn on the left wrist (normal watch for the right-handed), the hour and minute hands are superimposed at 12 hrs at noon or midnight. However, when the watch is worn on the right wrist (watch for left-handed people with control shaft at 9 hrs), the hands which are always superimposed at the same place in relation to a fixed point of reference such as the watch movement or the watch case, now do so at 6 hrs. And, in contrast, the hands are never superimposed at 12 hrs when the watch is worn on the right wrist because, as can seen, the hands are not superimposed at 6 hrs in a normal watch, i.e. one worn on the left wrist.

These display errors, which are inherent in this type of design, are sufficiently significant to impair the wearer's perception of time when the watch is worn on the right wrist, with the result that, in practice, these watches can only be used when worn on the left wrist.

OBJECTS OF THE INVENTION

The object of the invention is to overcome these disadvantages and to provide a watch which could in fact be worn on the left wrist or the right wrist, or used as a pocket watch and which, in each case, displays the time correctly.

BRIEF SUMMARY OF THE INVENTION

It is therefore an object of the invention to provide an analog timepiece having an hour hand, a minute hand, a watch movement to drive said hands and external control means to control the position of the hands, whereby to indicate a time reference the said hands occupy time references, said timepiece also having adjustment means to reorient said time references with respect to the position of the external control means.

BRIEF DESCRIPTION OF THE INVENTION

The adjustment means are preferably activated by a special manipulation of the control means and, in this mode, the said time reference can be indicated by one of the hands or by the two superimposed hands.

It will thus be understood, for example, that, taking noon as the time reference, it is sufficient to set this time reference at 12 hrs (read on the dial—fixed—of a watch designed to be worn normally on the left wrist) for the time to be read normally when the watch is worn on the left wrist, at 6 hrs (read on the same dial) for the time to be read normally when the watch is worn on the right wrist, and at 3 hrs (read on the same dial) for the time to be read normally when the watch is used as a pocket watch.

BRIEF DESCRIPTION OF THE DRAWINGS

The features and advantages of the invention will be better understood with reference to the following description given by way of non-limiting explanation, with reference to the enclosed drawings, in which.

DETAILED DESCRIPTION OF THE INVENTION

Figure 1:
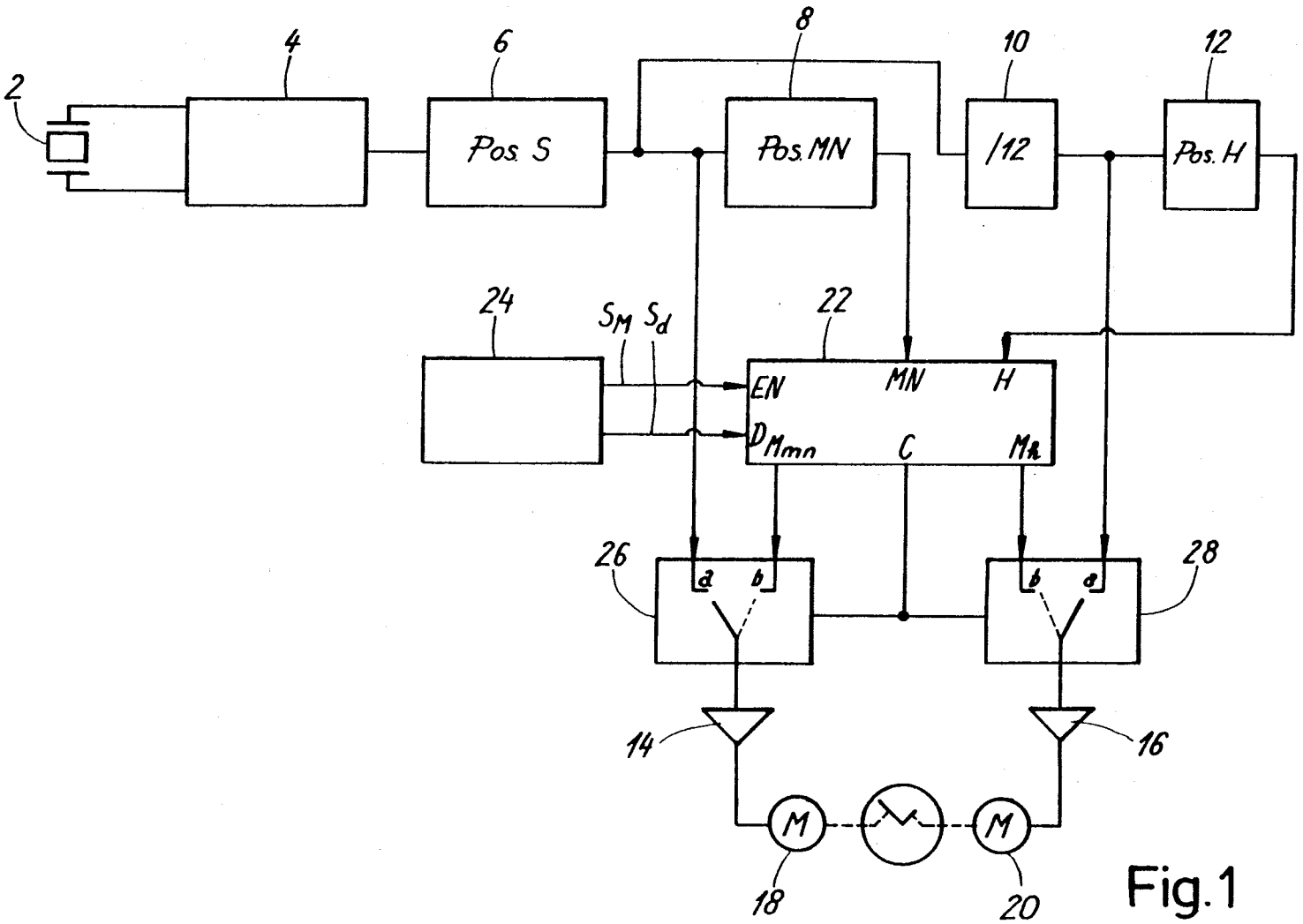
FIG. 1 shows a timepiece in accordance with the invention in the form of a block diagram.

FIG. 1 shows a timepiece of the invention in the form of a block diagram. This timepiece comprises in series a quartz oscillator 2, a divider 4 delivering a signal of 1 Hz, a second counter 6 and a minute counter 8. It also comprises a divider by twelve 10, receiving the output signal from the second counter 6, and an hour counter 12, the input of which is connected to the output of the divider 10. Counters 6, 8 and 12 are counters by sixty which define, in the normal manner, the position of the second, minute and hour hands in relation to the hour-circle of the dial of the timepiece.

In the embodiment shown, the timepiece has two motors 18, 20 controlled by power circuits 14, 16 respectively to drive the minute hand and the hour hand respectively. The circuits 18, 20 receive in the normal manner pulses applied to the inputs of the minute counter 8 and the hour counter 12 respectively.

In a conventional watch, the position of a given reference time, for example noon or midnight, is fixed in relation to the control shaft (or, which comes to the same thing, in relation to the watch movement or in relation to the case). This position is at 90° in the anti-clockwise direction in relation to the control shaft.

In accordance with the invention, the timepiece has adjustment means 22 which make it possible to change the position of the hands for a time reference. These adjustment means 22 have inputs MN and H to receive the contents of the minute counter 8 and the hour counter 12, an activation input EN and an input D for data on the displacement of the hands.

The signals applied to the inputs EN and D are supplied by an interpretation circuit 24 as a function of the position and displacement (direction and speed) of the control shaft.

The adjustment means 22 also have two outputs Mmn and Mh to deliver pulses to the motors 18 and 20, and a control output C to control the state of the two reversing switches 26, 28 arranged at the input of the power circuits 14, 16 and disposed to transmit thereto either pulses applied to the inputs of the minute counter 8 and hour counter 12 or pulses delivered by the adjustment means.

The adjustment means may advantageously take the form of an integrated circuit comprising a micro-programmed processor.

In the normal time display mode, the adjustment means are inactive and the motors 18, 20 receive pulses applied to the inputs of the minute and hour counters 8, 12.

Activation of the adjustment means 22 is achieved, for example, by special manipulation of the control shaft which induces the interpretation circuit 24 to emit an activation signal towards the input EN of the adjustment means 22.

Figure 2:
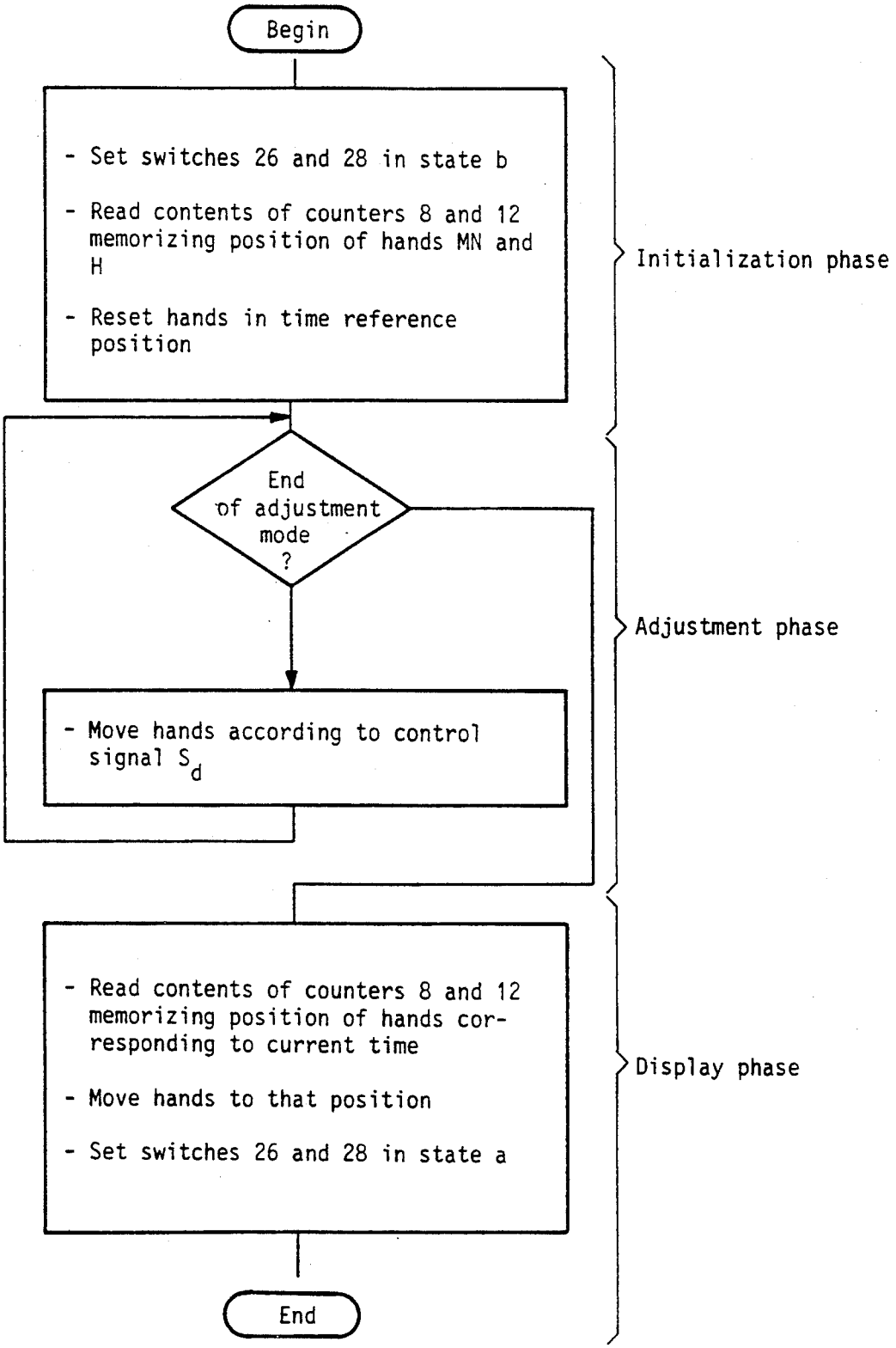
FIG. 2 is a flow chart showing the working of the adjustment means.

The adjustment means 22 then successively execute an initialization phase, an adjustment phase and a display phase, according to the flow chart in FIG. 2.

INITIALIZATION PHASE

The adjustment means 22 emit a signal to the output C to bring the switches 26 and 28 into state b, that is to block the pulses applied to the counters 8 and 12 and simultaneously read the contents of the counters 8 and 12 to register the position of the minute and hour hands. They then emit the requisite number of pulses to the outputs Mmn and Mh to bring the hands into the position corresponding to the said time reference (this does not affect the operation of counters 6, 8 and 12). For example, if the time reference is noon, the hands are brought to the position which they would have if the contents of counters 8 and 12 were equal to zero.

ADJUSTMENT PHASE

In this phase, the user defines the new position for the time reference by marking, using the hands, the position chosen for this time reference. Displacement of the hands is controlled by the control shaft, the movement thereof being interpreted by the circuit 24 which sends corresponding pulses to the input D of the adjustment means 22 which, in turn, emit to their outputs Mmn and Mh control pulses towards motors 18 and 20.

During this phase the hands preferably constantly remain superimposed. In other words, the adjustment means 22 or the user send the same pulses towards the two motors 18 and 20. This enables the user to see more clearly that the timepiece is in the adjustment mode.

It is of course also possible to make the adjustment means in such a way that only one of the hands is used to show the position of the time reference.

It is also possible to choose a time reference corresponding to different positions for the minute hand and the hour hand. For example, taking six hours (or eighteen hours) as the time reference, the hands are exactly opposite each other.

DISPLAY PHASE

When the user has marked the new desired position for the time reference he leaves the adjustment mode by manipulating the control shaft in a special way. The adjustment means 22 then read the contents of the minute counter 8 and the hour counter 12 which define the current time and emits the appropriate number of pulses to motors 14 and 16 to transfer the hands from the reference position towards the position displaying the current time.

For example, if the said time reference is noon or midnight, (which corresponds to the zero position in counters 8 and 12), it suffices to move each hand by a number of steps equal to the contents of the associated counter in order that the time is normally displayed in relation to the new position indicating noon or midnight.

The two following adjustment examples illustrate the functioning of the timepiece of the invention.

Figures 3A, 3B, 3C, 3D:
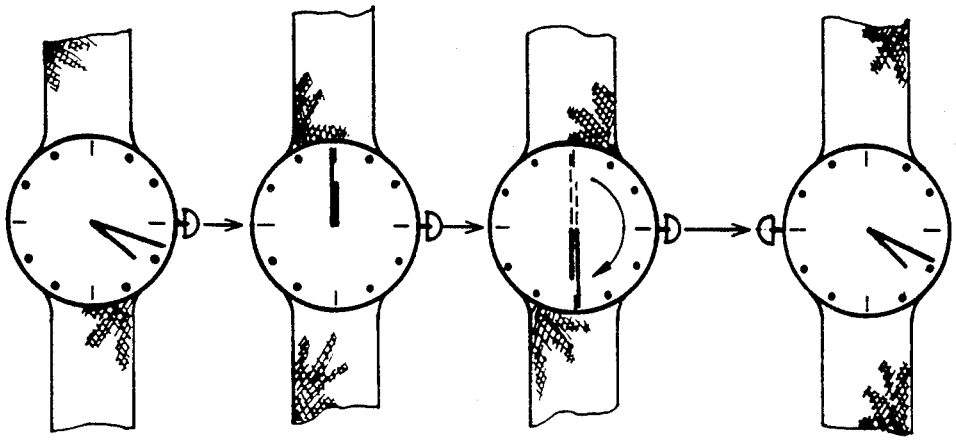
FIGS. 3*a* to 3*d* show how a timepiece of the invention, designed to be worn normally on the left wrist, can be converted into a wristwatch which can be worn on the right wrist.

FIG. 3*a* shows a wristwatch designed to be worn on the left wrist. The control shaft is therefore on the right. The dial is provided with four different indices at 12 hrs, 3 hrs, 6 hrs and 9 hrs. The minute and hour hands each move 60 steps for each revolution round the dial.

In the conventional manner, noon and midnight are shown by the superposition of the two hands at 12.00. This time is chosen as the time reference. The current time is thus 16 hrs 18 mins. The contents CPmn of the minute counter are thus equal to 18 and the contents $CP_H$ of the hour counter equal 21.

When the user goes into the adjustment mode, the two hands move until they reach the position marking the time reference (initialization phase). They are therefore superimposed at 12 hrs (see FIG. 3*b*).

The user then defines the new desired position for the time reference by marking this position with the hands (adjustment phase). In FIG. 3*c*, the new position for the time reference is at 6 hrs. This means that, at noon or at midnight, the hands are in the position shown in FIG. 3*c*.

The user then goes out of the adjustment mode. At this moment, the adjustment means move the hands (display phase) so that they show the current time, taking into account the new position of the time reference. In the example shown, where the time reference is noon or midnight, it is sufficient to move each hand forward by a number of steps equal to the contents of the corresponding counter (see FIG. 3*d*).

It should be noted that during every adjustment operation the counters continue to increase normally by the time base, with the result that the number of steps by which it is necessary to move the hands forward is not necessarily equal to the contents of the counters at the beginning of the adjustment operation.

The wristwatch can now be worn on the right wrist with the control shaft on the left. Adjustment of the position of the time reference makes it possible for the two hands to be superimposed at noon or midnight.

Using the same principle it is easily possible to convert a wristwatch, designed for example to be worn on the left wrist, into a pocket watch. FIGS. 4*a* to 4*d* illustrate this transformation.

Figures 4A, 4B, 4C, 4D:
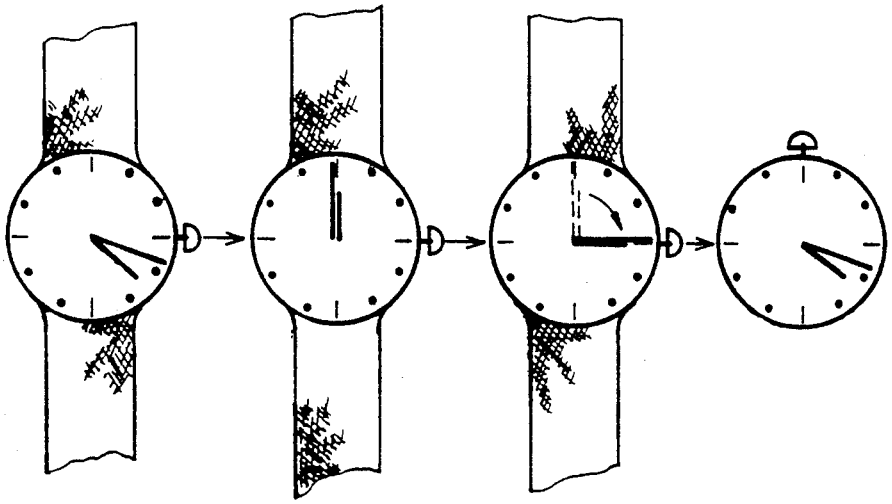
FIGS. 4*a* to 4*d* show how a timepiece of the invention, designed to be worn normally on the left wrist, can be converted into a pocket watch.

In FIG. 4*a* the wristwatch is intended to be worn on the left wrist with the control shaft on the right. The time reference chosen is noon / midnight and the position thereof is at 12 hrs.

Thus, when the user goes into the adjustment mode, the two hands move until they reach the position marking the time reference position (initialization phase) i.e. they are superimposed at 12 hrs (see FIG. 4*b*).

To transform the wristwatch into a pocket watch, the user then moves the hands to 3.00 hrs (see FIG. 4*c*) to indicate the new desired position for the time reference.

Returning to the normal mode, the adjustment means reposition the hands to display the current time, taking into account the new position of the time reference (see FIG. 4*d*).

In the above-described embodiments, the time reference is indicated by the position of the superimposed hands in the adjustment phase. It is clear that, to be able to superimpose the hands and to move them together, the watch movement must have one motor for each hand.

When there is a single motor to drive the two hands, it is possible to use the determined position of one hand to mark the position of the time reference. To adjust this time reference position it is of course necessary to have a disengaging system to break the kinematic connection between the two hands, at least during the display phase. This is easily done by coupling a wheel of the kinematic chain to the control shaft.

It is advantageously possible to provide the adjustment means with a table listing a limited number of permitted positions for the time reference. This table is preferably completed in the factory by the manufacturer of the timepiece.

In particular, when the time reference is noon / midnight, it is possible to stipulate that the possible positions are the four positions which, in a normal watch, indicate 3 hrs, 6 hrs, 9 hrs and 12 hrs.

I claim:

1. An analog timepiece comprising an hour hand, a minute hand, a watch movement for driving said hands, external control means for controlling the position of the hands, means for indicating a time reference by moving said hands to occupy a time reference position, and adjustment means for reorienting said time reference with respect to the position of the external control means.

2. A timepiece according to claim 1 wherein the adjustment means are actuated by specific manipulation of the external control means.

3. A timepiece according to claim 1, wherein said time reference indicating means includes means for defining said time reference by the position of a predetermined one of said hands, the position of said predetermined hand being set using said external control means.

4. A timepiece according to claim 1, wherein said indicating means defines said time reference in a position in which the hour and minute hands are superimposed, said time reference position of said hour and minute hands being set using said external control means.

5. A timepiece according to claim 4, further including driving means for the hour hand and driving means for the minute hand which are independent, at least when the adjustment means are actuated.

6. A timepiece according to claim 1 which comprises a counter for the position of the hour hand and a counter for the position of the minute hand, the contents of each counter being representative of the distance between the current position of the associated hand and the said time reference.

7. A timepiece according to claim 6 where the content of each counter equals zero when the hands are at said time references.

8. A timepiece according to claim 1 where the said time reference is midnight.

9. A timepiece according to claim 1 in which the adjustment means have a table memorizing a predetermined number of allowable positions for the time reference which can only be chosen when the adjustment means are actuated.

10. A timepiece according to claim 9 wherein the said predetermined permissible positions contained in said table are spaced apart at 90° from one another.

* * * * *